US009852858B2

(12) United States Patent
Kim

(10) Patent No.: US 9,852,858 B2
(45) Date of Patent: Dec. 26, 2017

(54) CONTACT OF VACUUM INTERRUPTER

(71) Applicant: LSIS CO., LTD., Anyang-si, Gyeonggi-do (KR)

(72) Inventor: Byungchul Kim, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 15/092,319

(22) Filed: Apr. 6, 2016

(65) Prior Publication Data

US 2016/0314916 A1 Oct. 27, 2016

(30) Foreign Application Priority Data

Apr. 22, 2015 (KR) ..... 10-2015-0056530

(51) Int. Cl.
*H01H 33/664* (2006.01)

(52) U.S. Cl.
CPC .... *H01H 33/6643* (2013.01); *H01H 33/6646* (2013.01); *H01H 2203/002* (2013.01)

(58) Field of Classification Search
CPC ..... H01H 33/66; H01H 33/6643; H01H 33/6646; H01H 33/6642; H01H 33/6644; H01H 2203/002
USPC ..... 218/127, 123, 128, 146, 118
See application file for complete search history.

(56) References Cited

U.S. PATENT DOCUMENTS 3,265,840 A * 8/1966 Luehring ..... H01H 1/0203 337/152
3,497,652 A * 2/1970 Horn ..... H01H 1/0203 218/132
3,845,262 A * 10/1974 Hundstad ..... H01H 33/6644 200/275
4,806,714 A * 2/1989 Aoki ..... H01H 33/6643 218/129
4,999,463 A * 3/1991 Yin ..... H01H 33/6643 218/128
5,103,069 A 4/1992 Yorita
(Continued)

FOREIGN PATENT DOCUMENTS

CN 1187779 2/2005
DE 202005021749 10/2009
(Continued)

OTHER PUBLICATIONS

European Patent Office Application Serial No. 16165341.5 , Search Report dated Aug. 1, 2016, 7 pages.
(Continued)

*Primary Examiner* — Renee S Luebke
*Assistant Examiner* — William Bolton
(74) *Attorney, Agent, or Firm* — Lee Hong Degerman Kang & Waimey

(57) ABSTRACT

A contact of a vacuum interrupter comprises a contact body portion formed in the shape of a circular plate, having a contact surface in a flat shape on one surface thereof, and provided with a plurality of cut portions formed in a spiral shape from a center of the contact surface toward an outer side in a radial direction, and an inclination area formed between the contact surface and an outer circumferential surface of the contact body portion, wherein the inclination area is provided with multi-stage inclined portions each forming a multi-stage inclination along the outer side of the contact body portion in the radial direction.

2 Claims, 7 Drawing Sheets

(56) References Cited

U.S. PATENT DOCUMENTS

| | | | | |
|---|---|---|---|---|
| 6,140,599 | A * | 10/2000 | Haas | H01H 33/6643 218/123 |
| 6,163,002 | A * | 12/2000 | Ahn | H01H 33/6643 218/123 |
| 6,762,388 | B2 | 7/2004 | Schellekens et al. | |
| 7,250,584 | B2 | 7/2007 | Asmus et al. | |
| 2002/0043514 | A1 | 4/2002 | Kim, II | |
| 2006/0124601 | A1* | 6/2006 | Asmus | H01H 33/6644 218/123 |

FOREIGN PATENT DOCUMENTS

| | | |
|---|---|---|
| JP | 5086678 | 7/1975 |
| JP | 01105428 | 4/1989 |
| JP | 3275670 | 4/2002 |
| JP | 4966076 | 7/2012 |
| JP | 2013062152 | 4/2013 |
| JP | 2015053169 | 3/2015 |
| KR | 101085286 | 11/2011 |
| KR | 101268309 | 5/2013 |

OTHER PUBLICATIONS

The Korean Institute of Patent Information Search Report dated Jul. 2, 2015 for Korean Application No. 10-2015-0056530, 3 pages.

State Intellectual Property Office of the People's Republic of China Application Serial No. 201610252087.0, Office Action dated Aug. 9, 2017, 6 pages.

* cited by examiner

CONTACT OF VACUUM INTERRUPTER

CROSS-REFERENCE TO RELATED APPLICATION

Pursuant to 35 U.S.C. §119(a), this application claims the benefit of earlier filing date and right of priority to Korean Application No. 10-2015-0056530, filed on Apr. 22, 2015, the contents of which are all hereby incorporated by reference herein in its entirety.

BACKGROUND OF THE INVENTION

1. Field of the Invention

The present invention relates to a contact of a vacuum interrupter, and more particularly, a contact of a vacuum interrupter capable of improving arc-extinguishing and insulating capabilities between contacts.

2. Background of the Invention

A vacuum interrupter is an electric power device, which is generally used as a core component of a vacuum circuit breaker or a switchgear for opening and closing a high voltage or super high voltage electric power circuit. The vacuum interrupter is provided with contacts within a vacuum container and can open and close a high voltage circuit over 1000 volts or a super high voltage circuit of tens of thousands of volts with an excellent arc-extinguishing performance.

Hereinafter, a general configuration and an operation of the vacuum interrupter will be described with reference to FIG. 1.

In general, the vacuum interrupter, as illustrated in FIG. 1, includes an insulating container 9, a movable electrode 1, a movable contact 2, a fixed electrode 4, a fixed contact 3, a fixed-side seal cup 8, a movable-side seal cup 7, a bellows tube 5, a bellows tube shield 6, and a center shield 10.

The insulating container 9 refers to a container for receiving therein the components of the vacuum interrupter. The insulating container 9 may be made of ceramic which is an electric insulating material, and formed in a cylindrical shape that both ends in a lengthwise direction are open.

The movable electrode 1 may be implemented as a conductive electrode, which is connected to a driving force transfer member, such as a rod, a lever or a link (not shown), and linearly movable by a driving force transferred from a driving power source, such as a motor or a spring (not shown) through the driving force transfer member.

The movable electrode 1 may be electrically connected to a load side of an electric power circuit, for example.

The movable contact 2 refers to a contact which is attached to one surface of the movable electrode 1 facing the fixed electrode 4 so as to be linearly movable together with the movable electrode 1. The movable contact 2 is made of a metal having characteristics, such as conductivity, resistance to fusion, current breaking, and high voltage withstand capability.

The fixed electrode 4 refers to an electrode which is located at a fixed position, and may be disposed to face the movable electrode 1. The fixed electrode 4 may be electrically connected to a power source side of the electric power circuit, for example.

The fixed contact 3 refers to a contact which is attached to one surface of the fixed electrode 4 facing the movable electrode 1 and fixed together with the fixed electrode 4. The fixed contact 3 is made of a metal having characteristics, such as conductivity, resistance to fusion, current breaking, and high voltage withstand capability.

The fixed-side seal cup 8 refers to a member in the shape of a cup with a low height so as to air-tightly close one of the openings at both ends of the ceramic insulating container 9, namely, one opening at which the fixed electrode 4 is disposed. The fixed-side seal cup 8 may be provided with a through hole formed through a center thereof such that the fixed electrode 4 is inserted therethrough.

The fixed-side seal cup 8 may be air-tightly welded on the ceramic insulating container 9 and the fixed electrode 4.

The movable-side seal cup 7 refers to a member in the shape of a cup with a low height so as to air-tightly close one of the openings at both ends of the ceramic insulating container 9, namely, one opening at which the movable electrode 1 is disposed. The fixed-side seal cup 8 may be provided with a through hole formed through a center thereof such that the movable electrode 1 is inserted therethrough.

The movable-side seal cup 7 may be air-tightly welded on the ceramic insulating container 9 and the bellows tube 5.

The bellows tube 5 is implemented as a metal tube which has a hollow inside such that the movable electrode 1 is inserted therethrough, and has a plurality of folds with flexibility so as to allow the movement of the movable electrode 1.

One end portion of the bellows tube 5 may be welded on the movable-side seal cup 7, and another end portion thereof may be welded on the bellows tube shield 6.

The bellows tube shield 6 is implemented as a metal member in the shape of a cup which surrounds the bellows tube 5 to protect the bellows tube 5 from arc, which is generated when the movable contact 2 is separated from the fixed contact 3, and metal vapors generated by the arc.

A penetrating portion formed at the center of the bellows pipe shield 6 may be welded on a flange which protrudes from an outer circumferential surface of the movable electrode 1, such that the bellows tube shield 6 can be linearly moved together with the movable electrode 1. Simultaneously, the another end portion of the bellows tube 5 can also be linearly moved together.

The center shield 10 may be supported by a shield supporting shaft 11 which is inserted into the ceramic insulating container 9, and also protect an inner wall of the ceramic insulating container 9 from the arc and the metal vapors.

Hereinafter, an operation of opening and closing an electric power circuit of the thusly-configured vacuum interrupter will be briefly described with reference to FIG. 1.

First, the operation of closing the electric power circuit will be described.

When the movable electrode 1 illustrated in FIG. 1 is moved up by a driving force which is generated from a driving power source such as the motor or the spring (not shown) and transferred through a driving force transfer member such as the rod, the lever or the link (not shown), the movable contact 2 attached to the movable electrode 1 is brought into contact with the corresponding fixed contact 3 of the fixed electrode 4. Accordingly, the load side connected with the movable electrode 1 and the power source side connected with the fixed electrode 4 are connected to each other. Consequently, the electric power circuit is closed and thus current flows from the power source side to the load side.

Next, the operation of opening the electric power circuit will be described.

When the movable electrode 1 illustrated in FIG. 1 is moved down by a driving force which is generated from a driving power source such as the motor or the spring (not shown) and transferred through a driving force transfer member such as the rod, the lever or the link (not shown), the movable contact 2 attached to the movable electrode 1 is separated from the corresponding fixed contact 3 of the fixed electrode 4. Accordingly, the load side connected with the movable electrode 1 and the power source side connected with the fixed electrode 4 are separated from each other. Consequently, the electric power circuit is open and thus current flowing from the power source side to the load side is broken.

Hereinafter, the contacts (movable contact and fixed contact) of the related art vacuum interrupter will be briefly described with reference to FIGS. 2 and 3.

Referring to FIG. 2, the contacts of the related art vacuum interrupter are so-called spiral contacts, and include the movable contact 2 and the fixed contact 3, as aforementioned. The movable contact 2 and the fixed contact 3 are supported by the movable electrode 1 and the fixed electrode 4, respectively.

Here, the movable contact 2 and the fixed contact 3 have the same structure.

The movable contact 2 may be provided with a plurality of cut portions 2*c* which are spirally formed from a center thereof toward an outer side in a radial direction. By the formation of the cut portions 2*c*, a plurality of spiral petal portions 2*b* are formed between the cut portions 2*c*.

Similarly, the fixed contact 3 may be provided with a plurality of cut portions 3*c* which are spirally formed from a center thereof toward an outer side in a radial direction. By the formation of the cut portions 3*c*, a plurality of spiral petal portions 3*b* are formed between the cut portions 3*c*.

The movable contact 2 and the fixed contact 3 in the spiral shape are separated from each other upon an opening operation, and accordingly arc is generated between the movable contact 2 and the fixed contact 3.

In this instance, the arc is rotated along the spiral petal portions 2*b* and 3*b* by a force, which is generated by interaction between an arc current flowing along the arc electrically connecting the movable contact 2 and the fixed contact 3 and a radial magnetic field generated by the arc current. Accordingly, the arc is evenly extinguished on surfaces of the movable contact 2 and the fixed contact 3.

Meanwhile, to improve an insulating property between the movable contact 2 and the fixed contact 3, as illustrated in FIG. 2, inclined portions S are formed at edge portions of the fixed contact 3 and the movable contact 2, on which an electric field is concentrated at the maximum.

The inclined portions S can increase a distance between the edges of the fixed contact 3 and the movable contact 2 on which the electric field has been concentrated at the maximum. This may result in reducing the electric field between the fixed contact 3 and the movable contact 2, and accordingly improving the insulating property between the fixed contact 3 and the movable contact 2.

However, in case where the inclined portions S have an inclination angle greater than a predetermined angle, an arc driving force involved in arc interruption is lowered, which may cause a number of arc interruption and a success rate of arc interruption to be reduced and lowered, thereby lowering arc extinguishing efficiency.

Meanwhile, in Korean Registration Patent No. 10-1085286 (Nov. 14, 2011) as a prior art of the present invention, 'Contact of Vacuum Interrupter' is disclosed.

SUMMARY OF THE INVENTION

Therefore, an aspect of the detailed description is to provide a contact of a vacuum interrupter capable of properly improving arc-extinguishment and insulating efficiencies between contacts.

To achieve these and other advantages and in accordance with the purpose of this specification, as embodied and broadly described herein, there is provided a contact of a vacuum interrupter, the contact including a contact body portion formed in the shape of a circular plate, having a contact surface formed in a flat shape on one surface of the contact body portion, and provided with a plurality of cut portions formed in a spiral shape from a center of the contact surface toward an outer side in a radial direction, and an inclination area formed between the contact surface and an outer circumferential surface of the contact body portion. The inclination area may be provided with multi-stage inclined portions each forming a multi-stage inclination along the outer side of the contact body portion in the radial direction.

Here, each of the multi-stage inclined portions may include a first inclined surface downwardly inclined to have a first inclination angle with respect to the contact surface, and a second inclined surface extending from the first inclined surface and having a second inclination angle with respect to the first inclined surface. The second inclination angle may be steeper than the first inclination angle.

Preferably, the first inclined surface and the second inclined surface may form multiple stages.

Preferably, the first inclined surface may be formed in a curved shape, and the second inclined surface may be formed in a linear shape.

Preferably, the first inclined surface and the second inclined surface may have different curvatures from each other.

Preferably, the curvature of the first inclined surface may be greater than the curvature of the second inclined surface.

Preferably, the contact of the vacuum interrupter may further include auxiliary inclined portions formed between the contact surface and each of inner walls formed on the contact body portion by the plurality of cut portions. Each of the auxiliary inclined portions may be downwardly inclined into a multi-stage shape from the contact surface.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

A detailed description of a contact of a vacuum interrupter according to the present invention will now be given with reference to the accompanying drawings.

Figure 4:
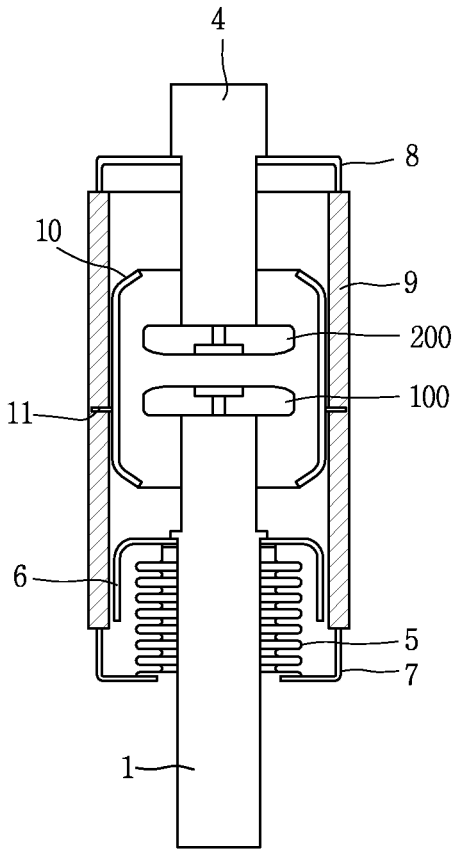
FIG. 4 is a view showing a configuration of a vacuum interrupter in accordance with the present invention.

FIG. 4 is a view showing a configuration of a vacuum interrupter in accordance with the present invention.

As illustrated in FIG. 4, the vacuum interrupter according to the present invention may include an insulating container 9, a movable electrode 1, a movable contact 100, a fixed electrode 4, a fixed contact 200, a fixed-side seal cup 8, a movable-side seal cup 7, a bellows tube 5, a bellows tube shield 6, and a center shield 10.

The insulating container 9 which is a container for accommodating the components of the vacuum interrupter, and may be formed of ceramic which is an electric insulating material. The insulating container 9 may be formed in a cylindrical shape.

The movable electrode 1 may be connected to a driving force transfer member, such as a rod, a lever or a link (not shown) so as to be linearly movable by a driving force transferred through the driving force transfer member. The movable electrode 1 may be configured as a conductive material.

The movable electrode 1 may be electrically connected to a load side of an electric power circuit.

The movable contact 100 may be attached to an upper end of the movable electrode 1 which faces the fixed electrode 4. The movable contact 100 may be made of a metal having characteristics, such as conductivity, resistance to fusion, current breaking, and high voltage withstand capability.

The fixed electrode 4 which is located at a fixed position may be disposed to face the movable electrode 1, and electrically connected to a power source side of the electric power circuit, for example.

The fixed contact 200 may be attached to a lower end of the fixed electrode 4 which faces the movable electrode 1. The fixed contact 200 may be made of the same material and in the same shape as the movable contact 100.

A detailed description of the movable contact and the fixed contact according to the present invention will be given as below.

The fixed-side seal cup 8 refers to a member in the shape of a cup with a low height so as to air-tightly close one of openings at both ends of the ceramic insulating container 9, namely, one opening at which the fixed electrode 4 is disposed. The fixed-side seal cup 8 may be provided with a through hole formed through a center thereof such that the fixed electrode 4 is inserted therethrough.

The fixed-side seal cup 8 may be air-tightly welded on the ceramic insulating container 9 and the fixed electrode 4.

The movable-side seal cup 7 refers to a member in the shape of a cup with a low height so as to air-tightly close one of the openings at the both ends of the ceramic insulating container 9, namely, one opening at which the movable electrode 1 is disposed. The fixed-side seal cup 8 may be provided with a through hole formed through a center thereof such that the movable electrode 1 is inserted therethrough.

The movable-side seal cup 7 may be air-tightly welded on the ceramic insulating container 9 and the bellows tube 5.

The bellows tube 5 may be implemented as a metal tube which has a hollow inside such that the movable electrode 1 is inserted therethrough, and has a plurality of folds with flexibility so as to allow the movement of the movable electrode 1.

One end portion of the bellows tube 5 may be welded on the movable-side seal cup 7, and another end portion thereof may be welded on the bellows tube shield 6.

The bellows tube shield 6 may be implemented as a metal member in the shape of a cup which surrounds the bellows tube 5 to protect the bellows tube 5 from arc, which is generated when the movable contact 2 is separated from the fixed contact 3, and metal vapors generated by the arc.

A penetrating portion formed at the center of the bellows pipe shield 6 may be welded on a flange which protrudes from an outer circumferential surface of the movable electrode 1, such that the bellows tube shield 6 can be linearly moved together with the movable electrode 1. Simultaneously, another end portion of the bellows tube 5 can also be linearly moved together.

The center shield 10 may be supported by a shield supporting shaft 11 which is inserted into the ceramic insulating container 9, and also protect an inner wall of the ceramic insulating container 9 from the arc and the metal vapors.

Hereinafter, the configurations of the movable contact and the fixed contact disposed in the vacuum interrupter will be described.

In the following description, the configuration of the movable contact will be described representatively because the movable contact and the fixed contact have the same configuration.

Figure 5A:
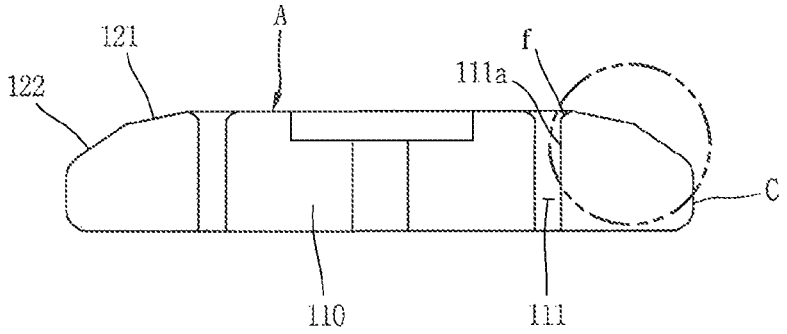
FIG. 5A is a cross-section showing a contact of the vacuum interrupter in accordance with the present invention.
Figure 5B:
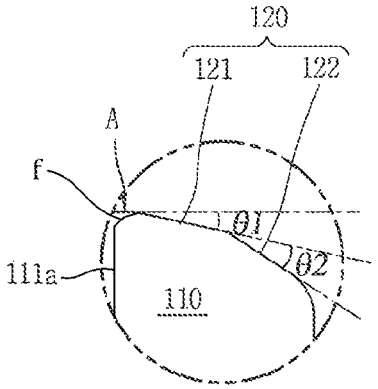
FIG. 5B is an enlarged view of a portion of the vacuum interrupter of FIG. 5A.
Figure 6:
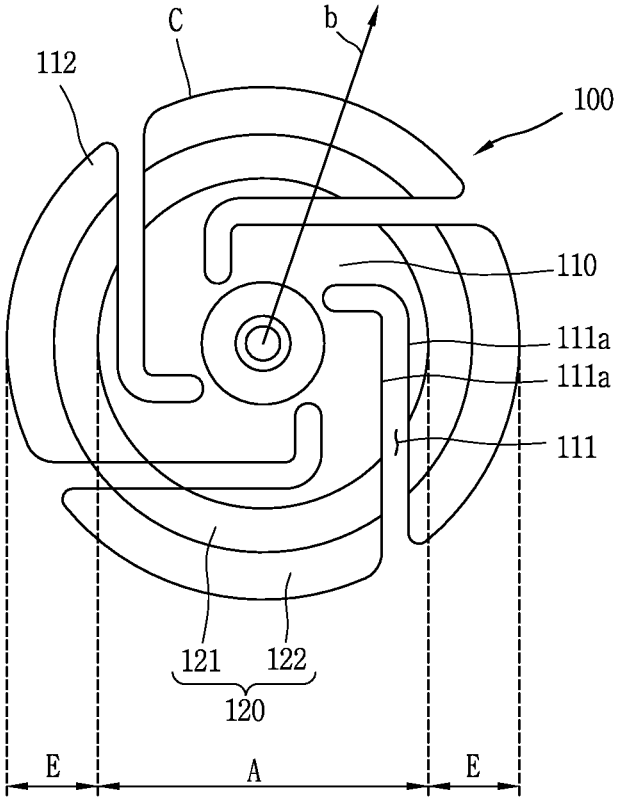
FIG. 6 is a planar view showing the contact of the vacuum interrupter in accordance with the present invention.

As illustrated in FIGS. 5A, 5B and 6, the movable contact 100 according to the present invention may have a contact body portion 110 with a contact surface A on an upper surface thereof.

Here, as illustrated in FIG. 6, an inclination area E with a predetermined width may be formed between the contact surface A and an outer circumferential surface C of the contact body portion 110.

The contact body portion 110 may generally be formed in the shape of a circular plate.

The contact body portion 110 may be provided with a plurality of cut portions 111 formed in a spiral shape from a center thereof to an outside in a radial direction. By the formation of the cut portions 111, a plurality of spiral petal portions 112 may be formed between the cut portions 111.

Here, as illustrated in FIG. 4, the movable contact 100 and the fixed contact 200 have the same shape, and they may be disposed to face each other in a vertical direction.

The contact surfaces A of the movable contact 100 and the fixed contact 200 may be brought into contact with each other upon a closing operation, and spaced apart from each other upon an opening operation.

The contact surface A may correspond to the remaining portion except for the inclination area E and be formed as a flat surface.

The inclination area E of the contact body portion 110 may include multi-stage inclined portions 120.

Each of the multi-stage inclined portions 120 may be formed on the contact body portion 110, and have a multi-stage inclination formed toward an outer side b in a radial direction of the contact body portion 110 at the inclination area E.

The multi-stage inclination may be an inclination with two stages or more.

The present invention exemplarily illustrates that each of the multi-stage inclined portions 120 forms a two-stage inclination.

Each of the multi-stage inclined portions 120 may be provided with a first inclined surface 121 and a second inclined surface 122.

The first inclined surface 121 may be downwardly inclined toward an outer side in the radial direction so as to have a first inclination angle θ1 with respect to the contact surface A.

Also, the second inclined surface 122 may extend from the first inclined surface 121. Here, the second inclined surface 122 may be downwardly inclined toward the outer side in the radial direction so as to have a second inclination angle θ2 with respect to the first inclined surface 121. The second inclination angle θ2 may be greater than the first inclination angle θ1.

Therefore, the first inclination angle θ1 may be formed smoother than the second inclination angle θ2 on the basis of the contact surface A.

That is, the multi-stage inclination may form inclination angles which gradually get steeper from an edge of the contact surface A toward the outer side of the contact body portion 110.

Hereinafter, an operation in case where the contacts having such configuration is disposed in the vacuum interrupter will be described.

The fixed contact 200 and the movable contact 100 according to the present invention may be formed in the same configuration.

As illustrated in FIG. 4, the fixed contact 200 may be fixed to a lower end of the fixed electrode 4, and the movable contact 100 may be fixed to an upper end of the movable electrode 1.

Each of the contact surface A of the fixed contact 200 and the contact surface A of the movable contact 100 may have a flat shape and the surfaces A of the movable contact 100 and the fixed contact 200 may be disposed to face each other.

In this state, in case of opening a vacuum circuit breaker after closed, when the movable electrode 1 is moved down by a driving force transfer member (not shown), the movable contact 100 and the fixed contact 200 may be separated from each other and arc may be generated at the moment.

In this instance, the arc is rotated by the spiral petal portions 112, in particularly, the first inclined surface 121, by a force, which is generated by interaction between an arc current flowing along the arc electrically connecting the movable contact 2 and the fixed contact 3 and a radial magnetic field generated by the arc current. Accordingly, the arc is evenly extinguished on surfaces of the movable contact 100 and the fixed contact 200.

Figure 1:
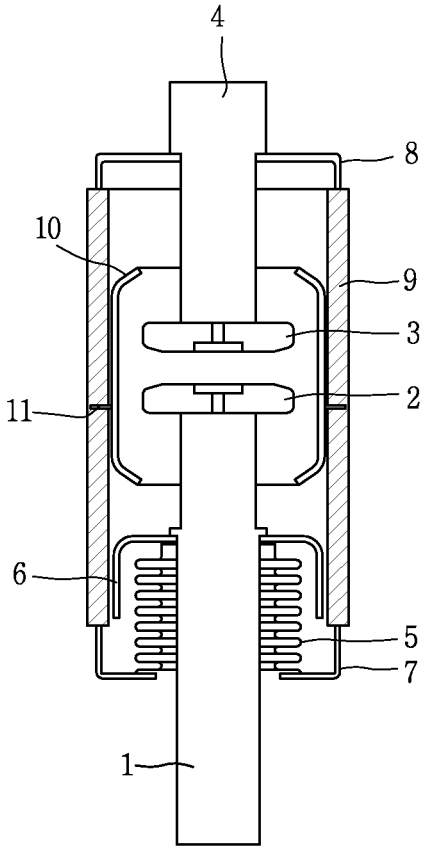
FIG. 1 RELATED ART
FIG. 1 is a view of a vacuum interrupter according to the related art.
Figure 2:
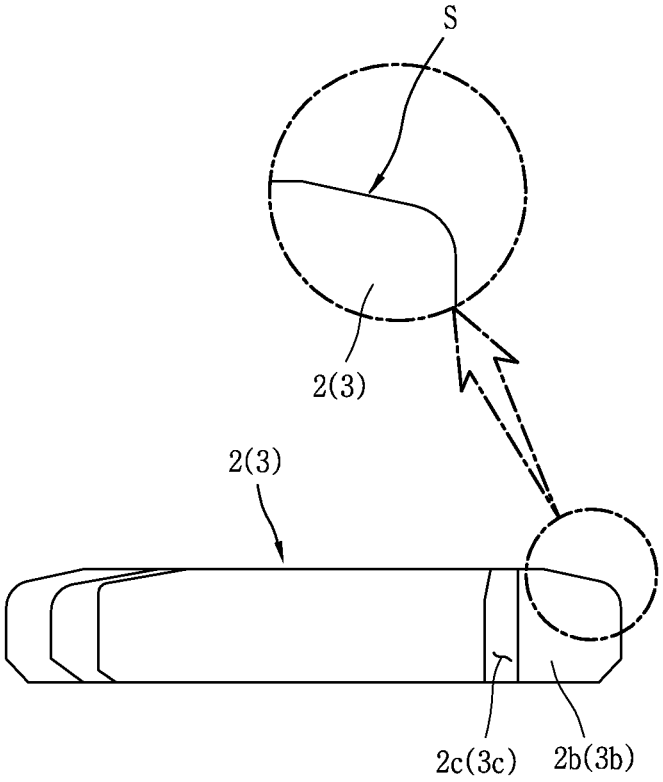
FIG. 2 RELATED ART
FIG. 2 is a side view showing a contact of the related art vacuum interrupter.
Figure 3:
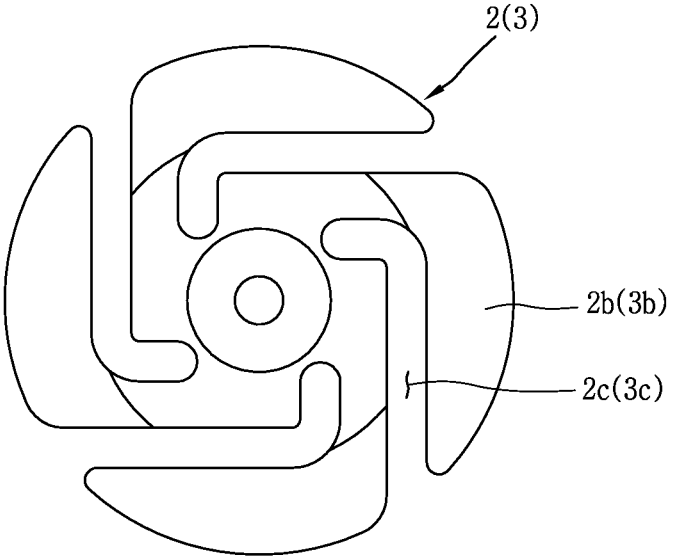
FIG. 3 RELATED ART
FIG. 3 is a planar view showing the contact of the related art vacuum interrupter.

The second inclined surface 122 of each of the multi-stage inclined portions 120 in the present invention may more increase a spaced distance between the fixed contact 200 and the movable contact 100, as compared with the case illustrated in FIG. 1, which may decrease an electric field generated between the fixed contact 200 and the movable contact 100, thereby ensuing insulating capability.

Consequently, the first inclined portion 121 according to the present invention may increase arc-extinguishing efficiency by inducing rotation of the arc, and the second inclined portion 122 may improve the insulating capability between the fixed contact 200 and the movable contact 100, thereby preventing damages on the fixed contact 200 and the movable contact 100.

The present invention has been described under assumption that the first inclination angle θ1 of the first inclined surface 121 is set in the range of 10 to 15° and the second inclination angle θ2 of the second inclined surface 122 is set in the range of 20 to 25°.

The reason of setting the first and second inclination angles θ1 and θ2 of the first and second inclined surfaces 121 and 122 may be as follows. Namely, the first inclination angle θ1 of the first inclined surface 121 may be set in the range of 10 to 15° to ensure arc extinguishing capability between the contacts, and the second inclination angle θ2 of the second inclined surface 122 may be set in the range of 20 to 25° to ensure the insulating capability between the contacts.

Figure 7:
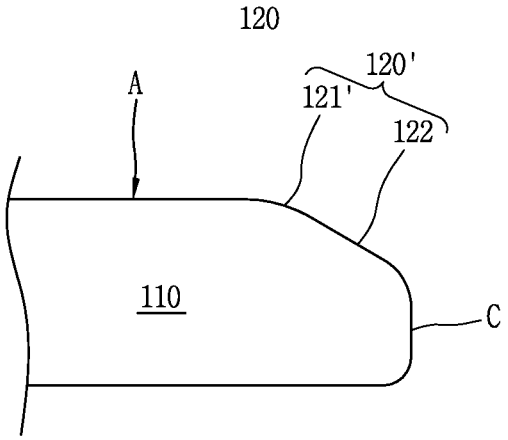
FIG. 7 is a view illustrating another embodiment of multi-stage inclined portions in accordance with the present invention.

FIG. 7 is a view illustrating another embodiment of the multi-stage inclined portions in accordance with the present invention.

As illustrated in FIG. 7, each of multi-stage inclined portions 120' may include a first inclined surface 121' formed in a curved shape and a second inclined surface 122 formed in a linear shape.

When the first inclined surface 121' is formed in the curved shape, as aforementioned, the first inclined surface 121' may induce rotation of arc such that the arc generated on the contact surface A upon the opening operation of the vacuum circuit breaker can be extinguished by the curved first inclined surface 121'.

Also, the second inclined surface 122 may has a linear inclination steeper than the first inclined surface 121'. This may sufficiently increase a spaced distance between the second inclined surfaces 122 of the respective fixed and movable contacts 200 and 100, so as to reduce an electric field, thereby improving the insulating capability between the fixed contact 200 and the movable contact 100.

Although not illustrated, the first inclined surface and the second inclined surface may also be formed to have different curvatures.

Preferably, the curvature of the first inclined surface may be greater than the curvature of the second inclined surface.

Therefore, arc generated upon separating the contacts may be distributed by the first inclined surface with the different curvature from the second inclined surface, and also a sufficient distance for reducing the electric field can be ensured by the second inclined surface.

Also, in order to reduce an electric field, the second inclined surface may preferably be wider in width than the first inclined surface.

In addition, as illustrated in FIGS. 5A, 5B, auxiliary inclined portions f which are downwardly inclined into multiple stages from the contact surface A may further be formed between the contact surface A and each of inner walls 111*a* (see FIG. 6) which are formed at the contact body portion 110 defined by the plurality of cut portions 111.

The auxiliary inclined portions f may be formed in the same configuration as the first and second inclined surfaces, so detailed description thereof will be omitted.

According to the present invention, an arc distribution, namely, arc-extinguishing efficiency can be improved by the formation of the multi-stage inclined portions and also an insulating performance can be ensured by reducing an electric field at each petal portion.

This may result in easily solving the problem that the contacts are fused or deformed due to the concentration of the electric field on the plurality of petal portions which are formed by the plurality of cut portions.

Meanwhile, when a plural form such as "(the) contacts" is used, it should be understood as referring to a movable contact and a fixed contact, separately. On the other hand, when a singular form such as "a (the) contact" is used, it should be understood as referring to one of the movable contact and the fixed contact.

The foregoing description has been given of the detailed embodiments related to the contact of the vacuum interrupter, but it may be obvious that different variations can be made without departing from the scope of the present invention.

Therefore, it should also be understood that the above-described embodiments are not limited by any of the details of the foregoing description, unless otherwise specified, but rather should be construed broadly within its scope as defined in the appended claims.

That is, the aforementioned embodiments are merely illustrative and should not be understood to be limited thereto. Also, all changes and modifications that fall within the metes and bounds of the claims, or equivalents of such metes and bounds are therefore intended to be embraced by the appended claims.

What is claimed is:

1. A contact of a vacuum interrupter, the contact comprising:

a contact body portion formed in the shape of a circular plate, and having a contact surface formed in a flat shape on one surface of the contact body portion, wherein the contact body portion is provided with a plurality of cut portions formed in a spiral shape from a center of the contact surface toward an outer side in a radial direction; and an inclination area formed between the contact surface and an outer circumferential surface of the contact body portion, wherein the inclination area is provided with multi-stage inclined portions each forming a multi-stage inclination along the outer side of the contact body portion in the radial direction, wherein each of the multi-stage inclined portions comprises a first inclined surface downwardly inclined to have a first inclination angle with respect to the contact surface, and a second inclined surface extending from the first inclined surface and having a second inclination angle with respect to the first inclined surface, the second inclination angle being steeper than the first inclination angle, and wherein the first inclined surface is formed in a curved shape, and the second inclined surface is formed in a linear shape.

2. The contact of claim 1, further comprising auxiliary inclined portions formed between the contact surface and each of inner walls formed on the contact body portion by the plurality of cut portions, the auxiliary inclined portions downwardly inclined into a multi-stage shape from the contact surface.

* * * * *